United States Patent [19]

Monn

[11] 4,313,401

[45] Feb. 2, 1982

[54] REGULATOR FOR AN INTERNAL COMBUSTION ENGINE

[76] Inventor: Walter Monn, Via Monte Tabor 8, 6512 Giubiasco, Switzerland

[21] Appl. No.: 7,930

[22] Filed: Jan. 30, 1979

[30] Foreign Application Priority Data

Feb. 2, 1978 [DE] Fed. Rep. of Germany ..... 2804432
Dec. 1, 1978 [CH] Switzerland ..... 12292/78

[51] Int. Cl.[3] ..... F01P 1/08
[52] U.S. Cl. ..... 123/414; 173/190 E
[58] Field of Search ..... 123/41.4, 190 E

[56] References Cited

U.S. PATENT DOCUMENTS 4,008,694 2/1977 Monn ..... 123/41.4

FOREIGN PATENT DOCUMENTS 159995 3/1921 United Kingdom .
535856 4/1941 United Kingdom .
632728 12/1949 United Kingdom .
771137 3/1957 United Kingdom .
859366 1/1961 United Kingdom .
1479347 7/1977 United Kingdom .

*Primary Examiner*—Charles E. Phillips

*Attorney, Agent, or Firm*—Lerner, David, Littenberg & Samuel

[57] ABSTRACT

A regulator for an internal combustion engine having at least one working cylinder space is disclosed. The regulator comprises a housing for connection to the engine and a rotary slide valve rotatably mounted in the housing to rotate on a rotation axis. The rotary slide valve has at least one passageway for alternatively connecting the cylinder working space with intake and discharge channels in the housing as the valve is rotated in the housing. Cooling means are also provided for cooling the rotary slide valve. The cooling means includes a coolant fluid inlet in the valve into which coolant fluid is introduced at a first radial position with respect to the rotation axis, and first and second cooling channel portions for conducting the coolant fluid through the rotary slide valve. The first cooling channel portion extends from the inlet to a second radial position located further from the rotation axis than the first radial position and the second cooling channel portion extends from the radial position to a third radial position located radially inward of the second radial position so that coolant is first conducted from an interior part of the valve radially outward to an exterior part of the valve and then is conducted radially inward into an interior part of the valve.

20 Claims, 7 Drawing Figures

REGULATOR FOR AN INTERNAL COMBUSTION ENGINE

BACKGROUND OF THE INVENTION

The present invention relates to regulators for an internal combustion engine, and more particularly to regulators utilizing rotary slide valves.

Regulators utilizing rotary slide valves generally include a housing for connection to an engine and having the rotary slide valve rotatably mounted in the housing to rotate on a rotation axis. The rotary slide valve includes passages which serve to connect at least one working cylinder space in the engine with one or more air intake channels or with one or more exhaust discharge channels. That is, as the rotary slide valve is rotated, the passages in the valve serve to alternately connect the cylinder working space with either an intake channel or discharge channel. Because of the substantial amounts of heat generated as a result of combustion in the cylinder which then must be exhausted through the discharge channels, it is known to provide a cooling system in the housing and the rotary slide valve for cooling of the housing and the rotary slide valve during operation. Coolant fluid is conducted through this cooling system by means of a vacuum site located outside of the rotary slide valve for drawing the coolant fluid through the housing and the rotary slide valve to cool same. In the known prior art systems, the rotary slide valve has cooling agent chambers and channels therein for conducting cooling agent from a radially interior portion to a radially exterior portion of the slide valve. For example, one prior art arrangement is disclosed in Patent CH-PA No. 575,071.

SUMMARY OF THE INVENTION

In accordance with the present invention, there is provided an improved regulator for an internal combustion engine which provides a simpler construction of such a regulator while also providing for an improved cooling thereof without bringing about new disadvantages. In particular, the present invention constitutes an improvement over the invention disclosed in the aforementioned Patent CH-PA No. 575,071. More particularly, in accordance with the present invention, there is provided a regulator for an internal combustion engine having at least one working cylinder space. The regulator comprises a housing for connection to the engine and a rotary slide valve rotatably mounted in the housing to rotate about a rotation axis. The rotary slide valve includes at least one passageway for alternately connecting the cylinder working space with intake and discharge channels in the housing as the valve is rotated in the housing. Cooling means for cooling the rotary slide valve are provided which comprises a coolant fluid inlet in the valve into which coolant fluid is to be introduced, the inlet being located at a first radial position with respect to the rotation axis, and first and second cooling channel portions in the rotary slide valve. The first cooling channel portion extends from the inlet to a second radial position located further from the rotation axis then the first radial position and the second cooling channel portion extends from the second radial position to a third radial position located radially inward of the second radial position so that coolant is first conducted from an interior part of the valve radially outward to an exterior part of the valve, and is then conducted radially inward to an interior part of the valve. In this way, improved and more intensive cooling of the slide valve is achieved while also allowing for a simpler construction of the regulator without introducing new disadvantages in bringing about the improved results.

According to a preferred embodiment of the present invention, the regulator includes a coolant fluid outlet in the valve located at the third radial position for withdrawing coolant fluid therefrom. According to a further preferred embodiment, the rotary slide valve comprises a disc-shaped member having a first surface and a second surface separated by a cylindrical peripheral surface, and in which the coolant fluid inlet is located in the first surface and the coolant fluid outlet located in the second surface so that coolant fluid is conducted from the first surface through the rotary slide valve to the second surface. According to another preferred embodiment, the first and second cooling channel portions extend between the first and second surfaces of the rotary slide valve and define a passageway having a cross-section which is either U-shaped, V-shaped, W-shaped or X-shaped.

According to another aspect of the present invention, the rotary slide valve is comprised of an inner part rotatably mounted within the housing to rotate about the rotation axis and a cover ring affixed to the peripheral cylindrical edge of the inner part. This arrangement is advantageous in that it allows for simplification for manufacture of the rotary slide valve, while at the same time allowing for the possibility of using different materials for the inner part and the cover ring. For example, in accordance with a preferred embodiment, the inner part of the rotary slide valve is comprised of cast metal and the cover ring comprises an annular band shrink-fitted thereto.

These and further advantages and characteristics of the present invention will be apparent from the following detailed description in which reference is made to the enclosed drawings which illustrate the preferred embodiment of the present invention.

DETAILED DESCRIPTION OF THE PREFERRED EMBODIMENT

Figure 1:
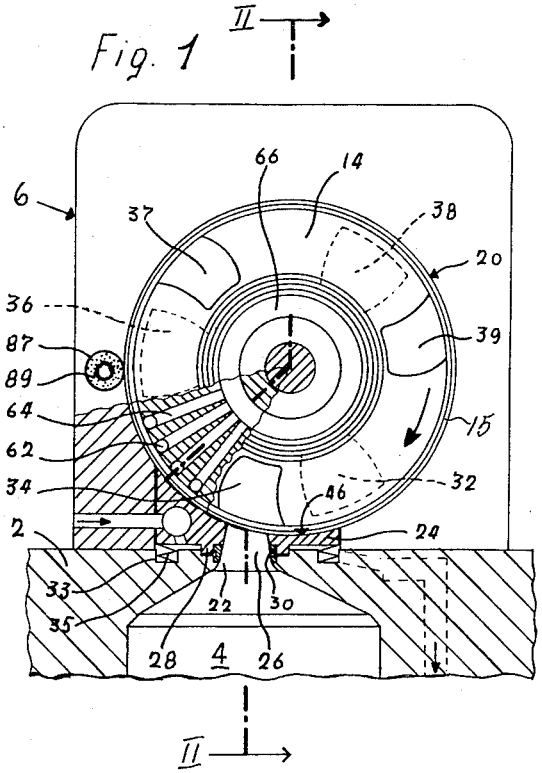
FIG. 1 shows a longitudinal cross-sectional view of the upper part of a cylinder head of an internal combustion engine with a regulator in accordance with the present invention thereon, the section being taken along lines I—I of FIG. 2 and portions being broken away for clarity.
Figure 2:
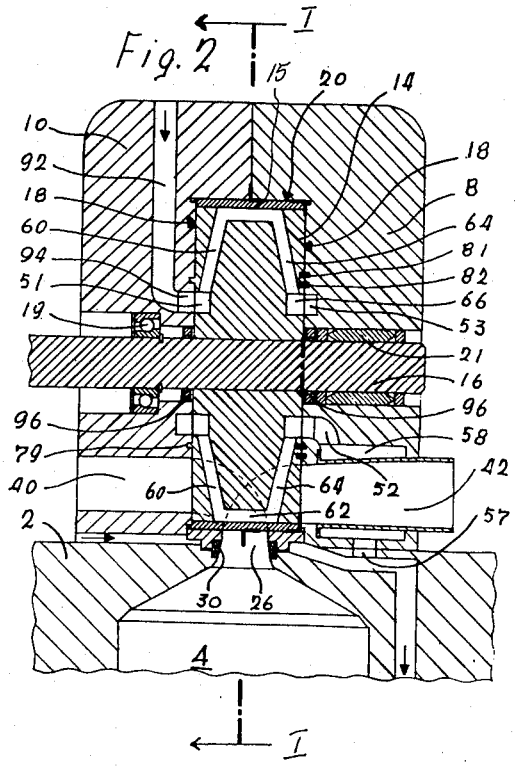
FIG. 2 is a cross-sectional view through the regulator according to FIG. 1, taken along lines II—II.

Referring now to the drawings in which like reference characters represent like components, FIGS. 1 and 2 show part of a cylinder head 2 of a four-stroke internal combustion engine having a working cylinder space 4. A housing 6 is connected to the cylinder head 2, such as for example by means of screws (not shown). The housing 6 is comprised of two housing halves 8 and 10 which are preferably held together by screws or bolts (not shown).

Between the two housing halves 8 and 10, there is a disc-shaped rotary slide valve 14. Its shaft 16 on one side is set in a bearing 19 in the housing half 10, which absorbs radial as well as axial forces, and, on the other side, in a sliding bearing 21 in the housing half 8, which absorbs only radial forces.

A bore 22, set off-center with regard to the axis of the shaft 16, and displaced in the direction of the rotation of the rotary slide valve 14, leads out of the working cylinder space 4 through the cylinder head 2 to the housing 6. A spring mounted sealer shoe 24 with a passage 26 is set in this bore 22. A cylindrical plug 28—part of the sealer shoe 24—has an inner gasket ring 30. The cylinder head 2 has depressions 33 radially outside the bore 22, to hold screw springs 35. The sealer shoe 24 is supported on these screw springs 35, and pressed against the rotary slide valve 14 by the spring action.

The rotary slide valve 14 has three pairs (six altogether) of passages 32, 34, 36, 37, 38 and 39 in the shape of 90° bends, and each pair displaced 120°. These passages alternately connect the mantle surface 20 with one or the other of front surfaces 18 of the valve 14. When the rotary slide valve 14 is in one of the correct positions, one of the intake passages 32, 36 or 38 connects an intake bore 40, which is in the housing half 10, with the passage 26 in the sealer shoe 24. The rotary slide valve 14 also has the three exhaust passages 34, 37, 39 displaced about 40° from the respective air intake passages 32, 36, 38, which connect the passage 26 with the exhaust discharge channel 42, located in the housing half 8. The cross-sections of the passages 32, 34, 36, 37, 38 and 39 are approximately rectangular on the mantle surface 20 of the rotary slide valve 14; in contrast the corresponding cross-sections on the front surfaces 18 of the rotary slide valve 14 are approximately kidney-shaped. The intake bore 40 and the exhaust discharge channel 42 each have circular cross-sections.

The connections mentioned, by means of the passages 32, 36, 38 between the intake bore 40 and the passage 26 on the one side, and the connections by means of the passages 34, 37, 39 between the passage 26 and the exhaust channel 42 on the other side, are only guaranteed when the rotary slide valve 14 is in the appropriate positions (FIG. 1 shows the exhaust discharge position of the rotary slide valve 14). In all other positions, the sealer shoe 24 with its contact surface 46 provides the necessary seal of the cylinder space 4 from the outside.

To cool the rotary slide valve 14 as well as the exhaust channel 42 in housing half 8, a cooling system is provided. More particularly, as FIG. 2 shows, the housing half 8 has a cooling agent feed bore 92, which leads into a ring groove 94. Across from this groove 94 there is an analogous ring groove 51 on the rotary slide valve 14. Cooling channels 60, distributed evenly in groups in the slide valve 14, lead out of the ring groove 51 from the interior part of the valve 14 to an exterior part of the valve 14. The cooling channels 60 end in spaces 62, which can be formed, e.g., as recesses or bores 62 substantially parallel to the rotating axis, as shown in FIGS. 1 and 2. The exits of these bores 62 lead into cooling agent channels 64, leading radially from the exterior part of the valve 14 to an interior part of the valve 14, which connect the bore 62 with another ring groove 66 in the proximity of the rotation axis of the rotary slide valve 14. It is to be noted that the channels 60, 62 and 64 define a coolant passageway through the valve 14 having a cross-section which is somewhat "U" or "V" shaped. The ring groove 66 feeds into another ring groove 53 in the housing half 8. The ring groove 53 in turn, by way of a segment-shaped channel 52, feeds into a recess which forms an elongated annular space 58 with respect to the exhaust channel 42 in the housing half 8. The space 58 is connected with a vacuum site, preferably of the motor, by way of a passage 57.

It was recognized that feeding cooling agent through the main shaft might be disadvantageous in a multiple-cylinder motor design. For this reason, the cooling agent feed bore 92 in the housing 10 was provided, as can be seen in FIG. 2. It should be noted that the ring groove 94 and 53 in the housing surround the elastic gaskets 96 on shaft 16 for sealing against leakage, and thus serve to protect the gaskets 96 against overheating.

Rings 79, 81, 82 which are recessed into and jut out of the faces 18 of the rotary slide valve 14, project into the corresponding grooves of the two housing halves 8 and 10 and thus form labyrinth gaskets. In this regard, it is to be noted that the rotary slide valve 14 does not metallically touch either of the two housing halves 8 or 10 surrounding it.

A bore 87 in the housing halves 8 and 10, serves to hold an oil strainer 89 in the form of an oil wick. This bore 87 touches the housing recess for the rotary slide valve 14 tangentially in such a manner that the oil strainer 89, which receives oil from the lubricating system of the internal combustion engine, deposits the oil on a small linear surface of the mantle surface 20 of the rotary slide valve 14. Since the spring mounted sealer shoe 24 can be made of self-lubricating bronze, at least in the area of its contact surface 46, friction resistance is thus reduced to a minimum, while at the same time an optimal seal is maintained.

The rotary slide valve 14 described, when used with four-stroke internal combustion engine to regulate it, is connected with this engine in such a manner that the rotary slide valve 14 carries out a one third revolution per each working cycle (i.e., two drive shaft revolutions of the motor), corresponding to the three intake and the three exhaust passages 32, 34, 36, 37, 38 and 39. The reduction rate is therefore 6 to 1.

For production-technological reasons, it might be advantageous to cast the inner part of the rotary slide valve 14 of a suitable metal and to then shrink fit an annular band 15 onto this part. This not only simplifies the manufacturing processing of the rotary slide valve 14, but also allows for the possibility of using different materials for the inner part of the annular band 15.

The regulator described works together with a four-stroke internal combustion engine in the following manner:

FIGS. 1 and 2 show the piston of the internal combustion engine in the explusion position, in which explosion gases are expelled from the working cylinder space 4 after having given off their pressure-dependent energy to the piston of the motor. This explusion is carried out through the passage 26 and the exhaust passage 34, into the exhaust discharge channel 42, from where the exhaust gases then flow into the open air.

During the subsequent intake stroke, the working piston goes down from its upper dead-center position in the cylinder space 4. The rotary slide valve 14 has continued to turn (in the direction of the arrow in FIG. 1), and now the intake passage 32 in the rotary slide valve 14 clears a continuously increasing passage to the passage 26 as well as the intake bore 40. By creating a vacuum in the working cylinder space 4, e.g., with the motor piston, the outside air is therefore drawn into the air intake passage 32 through the intake bore 40, and then from the former into the working cylinder space 4 through the passage 26. This continues until the back edge of the intake passage 32 passes the front edge of the intake bore 40 or that of the passage 26, and the working cylinder space 4 is therefore closed off to the outside, concluding the filling process of the working cylinder space 4.

In the subsequent compression stroke, the piston compresses the combustion air drawn into the working cylinder space 4, while fuel injection into the compressed air occurs at the correct moment, so that an explosive mixture is created. Of course, it is possible to connect a carburetor in front of the intake bore 40, so that it is not pure air which enters the working cylinder space 4 through the channels described above, but a mixture of air and gasoline vapor.

Shortly before the upper dead-center position of the piston is reached, this mixture is ignited by means of a spark plug, and exploded, whereby the pressure created pushes the piston down, while it gives off power to the crankshaft. This is the working stroke. During this time, the rotary slide valve 14 must seal the working cylinder space 4, so that the explosion gases under their high pressure do not explode uselessly to the outside, above the cylinder head 2 and the housing 6. For this reason, the sealer shoe 24 is set spring mounted in the cylinder head 2, so that it has the possibility of resting tightly against the rotary slide valve 14 with its contact surface 46, under the pressure in the working cylinder space 4 and the additional pressure of the screw springs 35. Then, the self-lubricating metal of which at least the contact surface 46 of the sealer shoe 24 is made acts to keep the friction and therefore the wear and lost power as low as possible. Sealing also occurs by means of the gasket ring 30.

At the end of the working stroke, when the piston is in its lower dead-center position, the rotary slide valve 14 has continued to turn in such a manner that now, during the subsequent exhaust stroke, which was described first, the connection of the working cylinder space 4 with the exhaust passage 39 and the exhaust channel 42 through the passage 26 is produced.

It is obvious that the regulator described is subject to very high thermal stresses, and this is especially true for the rotary slide valve 14 with the shaft 16, rotating in the housing halves 8 and 10, and the sealer shoe 24, as well as the exhaust channel 42. For this reason, these parts must be efficiently and effectively cooled, i.e., so intensively and securely that if possible no temperature peaks occur. For this purpose, cooling air enters the ring groove 66 of the rotary slide valve 14 through the channels 60, 62 and 64, by means of the vacuum in the crankshaft housing or another pump source; the other ring groove 53 in the housing 8 is across from the ring groove 66. The cooling air leaves this chamber 53 through the channel 52, from where it flows into the annular space 58.

The mantle surface 20 of the rotary slide valve is correspondingly oiled by means of the oil wick of strainer 89, while a sealing soot layer is formed between the inner wall of the housing half 8 and the rotary slide valve 14 or its corresponding front surface by the exhaust gases, which seals the entire system even better, in a natural manner.

Figure 3:
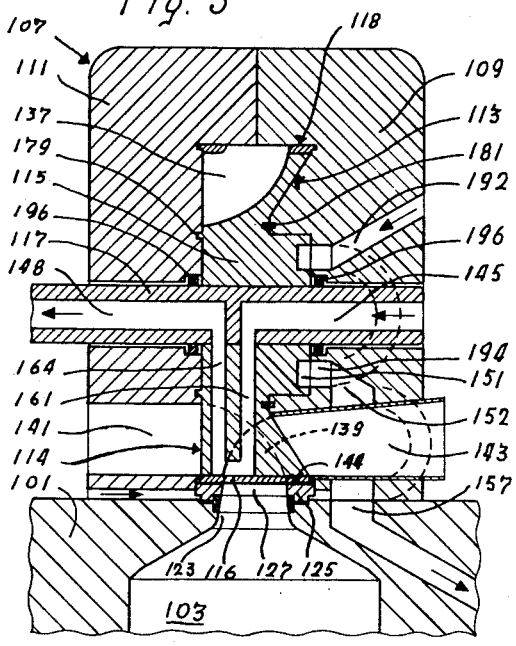
FIG. 3 is a cross-sectional view similar to that of FIG. 2, of another embodiment of a regulator according to the present invention.

A second embodiment of such a regulator is shown in FIG. 3.

Here, a part of a cylinder head 101 of a four-stroke internal combustion engine with a working cylinder space 103 is shown. On the cylinder head 101, a housing 107 is placed, such as for example by screws (not shown). This consists of two housing halves 109 and 111, which are held together, e.g., by screws. Between these two housing halves 109 and 111 there is provided a disc-shaped rotary slide valve 115 having its shaft 117 supported in the two housing halves 109 and 111 in a suitable manner.

A bore 123, set off-center with regard to the axis of the shaft 117, leads out of the working cylinder space 103 through the cylinder head 101 to the housing 107. In this bore 123, there is set a spring mounted sealer shoe 125 with a passage 127 having a known make-up.

Here also, the rotary slide valve 115 has three pairs (a total of six) passages 137, 139 in the form of 90° bends, each pair displaced 120°, which connect the mantle surface 118 and the one or the other front surfaces 113 or 114 of the rotary slide valve 115. The three air intake passages 137, each displaced 120° relative to the others, each connect an intake bore 141, located in the housing half 111, with the passage 127 in the sealer shoe 125. The rotary slide valve 115 also has the three exhaust passages 139, displaced about 40° relative to the respective air intake passages 137, which connect the passage 127 with the exhaust discharge channel 143, located in the housing half 109. The cross-sections of the passages 137 and 139 are approximately rectangular on the mantle surface 118 of the rotary slide valve 115, while the corresponding cross-sections on the front surfaces 113 or 114 of the rotary slide valve 115 are approximately kidney-shaped. The intake bore 141 and the exhaust discharge channel 143 have approximately circular cross-sections.

The connections mentioned, by means of the passages 137 between the intake bore 141 and the passage 127 on the one side and the connections by means of the passages 139 between the passage 127 and the exhaust discharge channel 143 on the other side are only guaranteed when the rotary slide valve 115 has been rotated into the appropriate positions.

In FIG. 3, the slide valve 15 is in the working stroke, i.e., before the exhaust explusion position of the rotary slide valve 115.

To cool the rotary slide valve 115 as well as the exhaust discharge channel 143, the following is thus provided:

The shaft 117 has a central, axial cooling agent feed bore 145 and an outlet bore 148, which are separated by a crossbar. There are lateral connecting bores to the bores 145 and 148 in the shaft 117, corresponding to the cooling agent channels 161, 162 and 164 between the six passages 137, 139, which guarantee the flow of cooling agent in the slide valve 115. Here, the channels define a "U" shaped coolant passageway through the valve 115. The channels 161 and 164 serve to promote the flow in the slide valve 15, in the same manner as the channels 60 and 64 do. Cooling can be carried out here by water, oil or a similar material. In this regard, it is to be noted that, aside from the shaft connections, the entire system is completely free of leaks.

In this embodiment, there is provided a second cooling system, which cools a hub part of the rotary slide valve 115 and subsequently the exhaust discharge channel 143 or the inset piece forming the channel 143. The cooling agent is here fed through a housing bore 192, which leads into an annular chamber 194. This continues as an annular chamber 151, as FIG. 3 clearly shows. The cooling agent flows from the chamber 194 through at least one passageway, e.g., a ring-segment-shaped bore, into an annular space 152, which directly surrounds the wall of the channel 143 and brings about the desired intensive cooling. Subsequently, the cooling agent flows through a channel 157 in the cylinder head 101 to an intake location, e.g., in the motor housing.

The arrangement of this cooling system brings about such effective, and intensive cooling that the two gasket rings 196 on shaft 117 can be made of material that is only heat-resistant up to approximately 110° C., commonly known as cold motor gaskets.

In order to minimize the heating up of the rotary slide valve 115, the profile of the slide valve 115 is chosen to minimize the surface area in contact with the exhaust gases. In particular, the slide valve 115, as shown, has a ring groove having a triangular shaped cross-section in the surface 113 adjacent the radial position of the exhaust channel 143. This decreases the above-mentioned surface in the slide valve 115 by about one-third.

Rings 179 and 181 which project from the front surfaces 113 and 114 of the rotary slide valve 115 sit in corresponding grooves in the two housing halves 109 and 111 and thus form labyrinth seals. Again, it is to be noted that the rotary slide valve 115 does not touch either of the two housing halves 109 and 111 which surround it. Further, it is to be noted that the rotary slide valve 115 includes an annular band 116 affixed to the inner part of the valve 115, e.g., by shrink-fitting.

Here also, a bore in the housing 109, 111 can be provided to hold an oil strainer in the form of an oil wick. This bore touches the housing recess for the rotary slide valve 115 tangentially, as explained in detail for FIG. 1. Since the spring mounted sealer shoe 125 may consist of self-lubricating metal, e.g., self-lubricating bronze, at least in the area of its contact surface 144, the friction resistance is reduced to a minimum here also, while maintaining optimal sealing.

The rotary slide valve 115 described is connected with a four-stroke internal combustion engine when it is used to regulate it in such a manner, that the rotary slide valve 115 carries out one third of a revolution per working cycle (i.e., two crank shaft revolutions of the motor), corresponding to the three intake and the three exhaust passages. Therefore, the reduction ratio is 6 to 1.

The regulator described essentially works analogously with a four-stroke internal combustion engine as described for the embodiment according to FIGS. 1 and 2.

Figure 4:
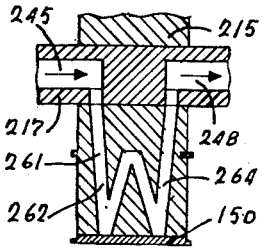
FIGS. 4 and 5 are cross-sectional views through portions of two further embodiments of rotary slide valves in accordance with the present invention to show the placement of the cooling channels therein.
Figure 5:
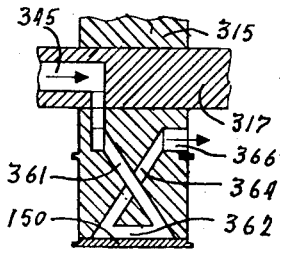

FIGS. 4 and 5 show two further embodiments for the rotary slide valve showing different possibilities of feeding cooling agent into the rotary slide valve. FIG. 4 shows a shaft 217 with an axial bore 245 for introducing the cooling agent and an analogous axial bore 248 for withdrawing the cooling agent and conducting it away from the slide valve 215. The cooling agent is conducted from the feed bore 245 to the outlet bore 248 via lateral openings in the shaft 217, into the cooling agent channels 261, 262, and 264 and then through appropriate lateral openings in shaft 217 into bore 248. It should be noted that the coolant channels 261, 262 and 264 thus define a passageway through the valve having a cross-section in the shape of a "W". Here also, a ring 150 is applied to the inner part of the rotary slide valve 215, for example by being shrink-fitted on.

Another possibility of carrying cooling agent is shown in FIG. 5, with a shaft 317 of the rotary slide valve 315. Here, there is an axial feed bore 345 for the cooling agent, which is conducted into channels 361, 363 and 364 set in the interior of the rotary slide valve 315 through lateral passages. Here, a partial ring groove 366 is used as the outlet opening in the rotary slide valve 315, and a ring groove is located across from it in the housing (not shown). It is to be noted that this arrangement of coolant channels 361, 362 and 364 define an "X" shaped passageway through the valve 315.

Figure 6:
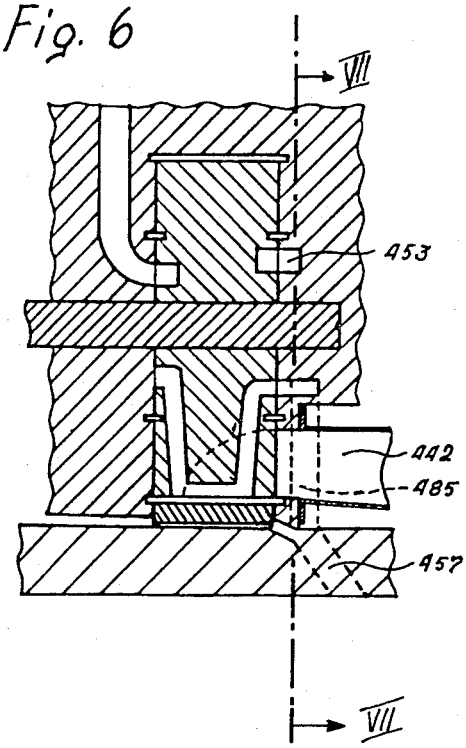
FIG. 6 is a cross-sectional view analogous to those shown in FIGS. 4 and 5 showing a further embodiment of the present invention.
Figure 7:
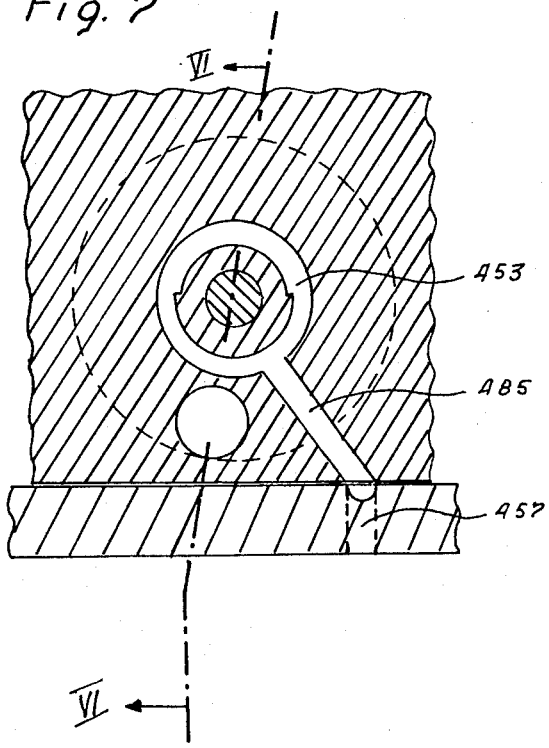
FIG. 7 is a sectional view of the embodiment according to FIG. 6, taken along lines VII—VII.

A somewhat structually simpler embodiment is shown in FIGS. 6 and 7. Here, the cooling flow is conducted from a ring groove 453 through a radial bore 485 directly into the main intake channel 457. The exhaust pipe or channel 442 in the housing is freely accessible and is only cooled from the outside. Further, it should be noted that the cross-section of the ring groove 453 is somewhat larger in order to cool the gasket ring better.

Thus, in accordance with the present invention, cooling agent channels or recesses in a rotary slide valve are provided that lead from the interior to an exterior part of the valve and then back to the interior. Such an arrangement not only brings about a significant simplification in production, but also results in better cooling of the decisive parts.

The figures show examples of possibilities for carrying cooling agent in rotary slide valves. These channels form channel groups (between the passages for intake and exhaust of the motor gases), which are located symmetrically in the rotary slide valve, and therefore, depending on the number in the group, make it possible to guarantee a more uniform and less location-dependent temperature. This in turn makes possible a higher thermal carrying capacity of the rotary slide valve, which increases, at least theoretically, with the number of passages in the rotary slide valve. Depending on the number of passage groups the diameter of the rotary slide valve must of course be correspondingly increased.

The cooling system in accordance with the present invention may utilize a liquid, air or any other medium. The excess pressure or vacuum that is necessary to keep the fluid in motion can preferably be produced by the motor itself or by a unit attached to the motor.

These examples of different embodiments show that the cooling agent channels in rotary slide valves can be arranged in various ways for a regulator. It will thus be understood that such are merely illustrative and that changes may be made without departing from the scope of the invention as claimed.

What is claimed is:

1. A regulator for an internal combustion engine having at least one working cylinder space, said regulator comprising:

a housing for connection to said engine;

a rotary slide valve rotatably mounted in said housing to rotate about a rotation axis, said rotary slide valve having at least one passageway for alternatively connecting the cylinder working space with intake and discharge channels in said housing as said valve is rotated in said housing; and cooling means for cooling said rotary valve, said cooling means including:

a coolant fluid inlet into which coolant fluid is introduced in said valve at a first radial position with respect to said rotation axis;

a first cooling channel portion extending from said inlet to a second radial position located further from said rotation axis than said first radial position; and a second cooling channel portion extending from said second radial position to a third radial position located radially inward of said second radial position so that coolant is first conducted from an interior part of said valve outwardly to an exterior part of said valve, and is then conducted inwardly to an interior part of said valve.

2. The regulator of claim 1 wherein said coolant fluid inlet is closer to said rotation axis than to the periphery of said rotary slide valve, and wherein said second radial position is adjacent the periphery of said rotary slide valve.

3. The regulator of claim 1 further including an outlet in said rotary slide valve for withdrawing coolant fluid therefrom.

4. The regulator of claim 3 wherein said rotary slide valve comprises a disc shaped member having a first surface and a second surface separated by a peripheral cylindrical surface.

5. The regulator of claim 4 wherein said inlet is in said first surface and wherein said outlet is in said second surface so that fluid is conducted through said rotary slide valve from said first surface to said second surface.

6. The regulator of claim 5 wherein said inlet comprises an annular groove in said first surface of said slide valve.

7. The regulator of claim 6 wherein said outlet comprises an annular groove in said second surface of said slide valve.

8. The regulator of claim 7 wherein said housing includes an inlet passage for coolant fluid communicating with said annular groove in said first surface of said rotary slide valve and an outlet passage for coolant fluid communicating with said annular groove in said second surface of said rotary slide valve.

9. The regulator of claim 8 further including an elastic gasket ring on said shaft on opposite sides of said rotary slide valve for sealing against the leakage of coolant fluid, and wherein said housing includes annular cooling chambers surrounding said elastic gasket rings to protect said rings against overheating, said annular cooling chambers being positioned between said coolant inlet passageway in said housing and said coolant fluid inlet in said rotary valve and between said coolant outlet passageway in said housing and said coolant fluid outlet in said rotary valve.

10. The regulator of claim 8 wherein said outlet passageway in said housing includes a portion conducting coolant fluid around said exhaust channels passing therethrough.

11. The regulator of claim 8 wherein said cooling means is connected to a vacuum means located externally of said rotary slide valve for conducting cooling fluid through said rotary slide valve, said vacuum means being located downstream of said passageways through said rotary slide valve.

12. The regulator of claim 11 wherein said vacuum means is in said outlet coolant passageway in said housing.

13. The regulator of claim 3 further including a rotatable shaft on which said rotary slide valve is mounted and wherein said first radial position is in proximity to said shaft.

14. The regulator of claim 13 wherein said shaft includes an inlet passage therein for introducing coolant fluid into said inlet of said rotary slide valve.

15. The regulator of claim 14 wherein said third radial position is adjacent said shaft and wherein said shaft includes an outlet passage therein for withdrawing coolant fluid from said rotary slide valve.

16. The regulator of claim 4 wherein said second surface includes an annular groove therein, wherein said rotary slide valve includes a plurality of said passageways for alternately connecting said cylinder working space with intake and discharge channels in said housing, and wherein at least one of said passageways for connecting the cylinder working space with said discharge channel passages through said annular groove in said second surface.

17. The regulator of claim 4 wherein said first and second channel portions define a passageway through said rotary slide valve having a U-shaped cross-section.

18. The regulator of claim 4 wherein said first and second channel portions define a passageway through said rotary slide valve having a V-shaped cross-section.

19. The regulator of claim 4 wherein said first and second channel portions define a passageway through said rotary slide valve having a W-shaped cross-section.

20. The regulator of claim 4 wherein said first and second channel portions define a passageway through said rotary slide valve having a X-shaped cross-section.

* * * * *